United States Patent [19]

Gorlach et al.

[11] 4,127,282

[45] Nov. 28, 1978

[54] SKATE BOARD VEHICLE

[76] Inventors: Hans Görlach, Lerchenfeldstr. 14, 8950 Kaufbeuren-Neugablonz; Heinz Nolte, 8939 Jengen, both of Fed. Rep. of Germany

[21] Appl. No.: 795,549

[22] Filed: May 10, 1977

[30] Foreign Application Priority Data

Feb. 23, 1977 [DE] Fed. Rep. of Germany ..... 7705511

[51] Int. Cl.[2] ..... A63C 17/14

[52] U.S. Cl. ..... 280/87.04 A; 188/29; 280/11.2

[58] Field of Search ..... 280/11.2, 87.04 A; 188/29, 167

[56] References Cited

U.S. PATENT DOCUMENTS

| | | | |
|---|---|---|---|
| 2,865,645 | 12/1958 | Levin | 280/11.2 |
| 3,385,608 | 5/1968 | Waddell | 188/29 X |
| 4,037,852 | 7/1977 | Bayer et al. | 280/11.2 X |

*Primary Examiner*—Joseph F. Peters, Jr.
*Assistant Examiner*—Gene A. Church
*Attorney, Agent, or Firm*—Holman & Stern

[57] ABSTRACT

A skate board vehicle comprising a platform for supporting the user of the vehicle, and including front and rear wheel-and-axle supports in which at least one of the wheel-and-axle supports includes a supporting bearing block reciprocatingly supporting a slide element carrying a pivot pin pivotally mounting a steerable axle-and-wheels, the pivot pin having mounted thereon an axle-support sandwiched between a pair of resilient elements, and a brake assembly incorporating a hairpin-spring type element having braking arms normally urged onto the outer circumference of a pair of spaced wheels, and a coil spring interposed between the slide and an abutment projecting from the undersurface of the skate board vehicle platform, so that the skate board vehicle has shock-absorbing characteristics, is steerable, and the brake assembly is weight-responsive so that when a user's weight is imposed on the platform of the skate board vehicle, the brake is released and the skate board vehicle is used in a conventional manner, but when the skate board is used on a relatively steep slope, for example, and a user falls off or steps off, the wheels of the skate board will automatically be braked.

10 Claims, 10 Drawing Figures

FIG. 1
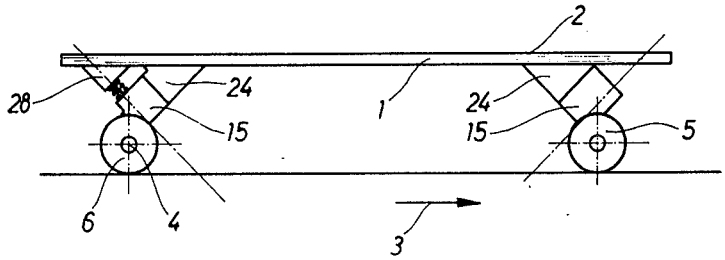
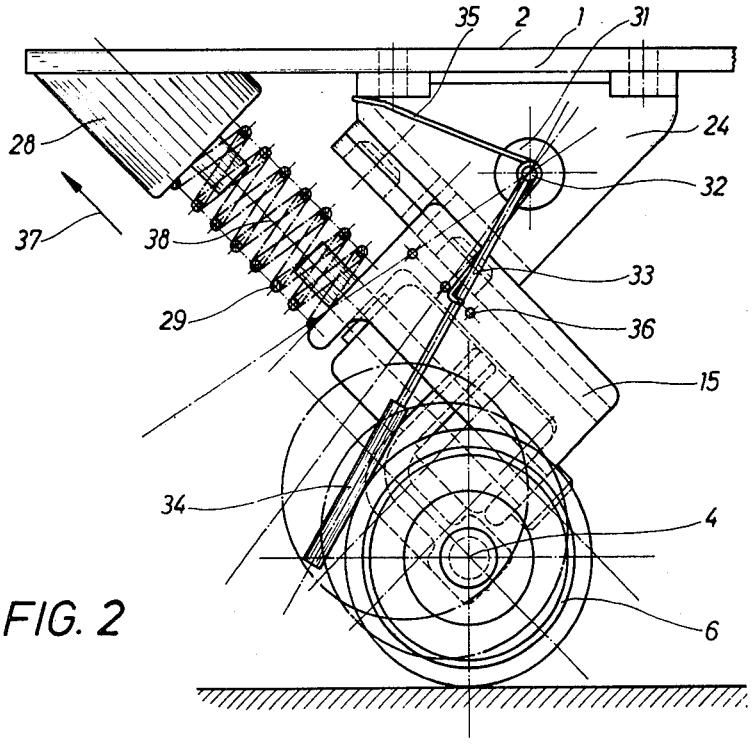
FIG. 2

FIG. 6
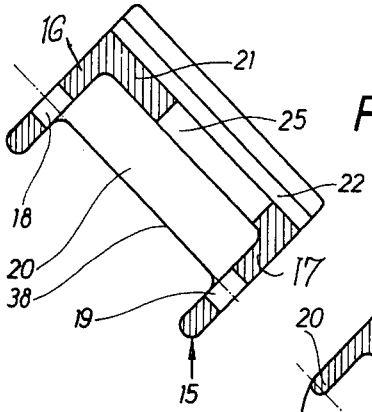
FIG. 8
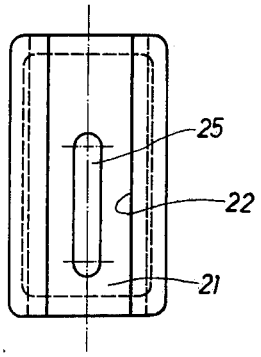
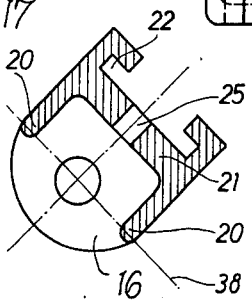
FIG. 7
FIG. 4
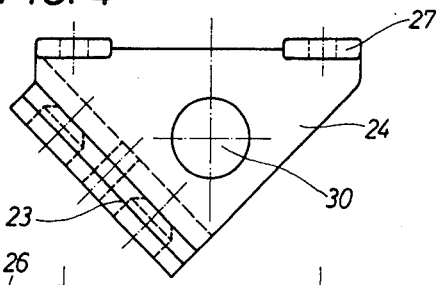
FIG. 9
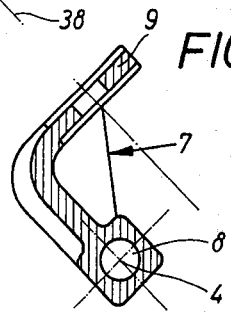
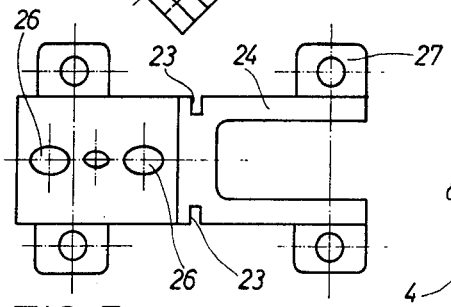
FIG. 5
FIG. 10
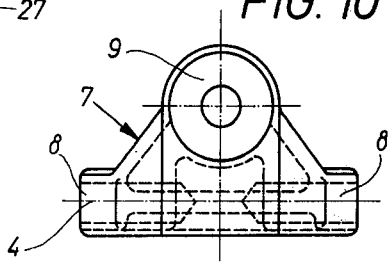

SKATE BOARD VEHICLE

FIELD OF THE INVENTION

The instant invention generally concerns skate board vehicles, i.e., an amusement or exercising device, generally characterized by a platform having front and rear wheel- and axle-assemblies; the platform being dimensioned to permit the user of the skate board vehicle to stand on the same with both feet.

BACKGROUND OF THE INVENTION

Generally, wheel- and-axle assemblies, of the character involved, incorporate two wheels and provide a relatively wide track, however, it is possible to provide on skate boards a single wheel supported on an axle, and thus provide a relatively narrow track, for example.

Although prior art skate board vehicles offer much versatility during use, and are continuously being improved, when skate board vehicles are used on a relatively steep slope, there exists the danger that the skate board, without the occupant thereon, to continue rolling down the slope, after the occupant has fallen or stepped off, and the run-away skate board vehicle both can inherently be the source of a dangerous accident to individuals and the like disposed downhill.

SUMMARY OF THE INVENTION

The invention generally comprises an improved skate board vehicle providing means for braking the skate board vehicle during a — run-away condition — downhill, and further comprising improved movement characteristics in which the control and steering is improved in conjunction with a relatively simple and staple construction which will provide a continued use over a long period of time.

More particularly, the platform of the skate board vehicle is supported between two wheel- and-axle assemblies; including compressible spring means between the platform and at least one of the wheels, and weight-activated brake means on the skate board affecting rotation of one of the wheels, and in which the brake means is normally in engagement with the one wheel and is moved to an inoperative position by means of carrier plates when the occupant of the platform is disposed thereon.

Accordingly, during use and when a user's weight is imposed on the platform, compression of the spring means disengages the brake means, and the skate board vehicle is used in a customary conventional manner without interference of said brake means, however, the brake system becomes operative when the user is off the skate board vehicle and the brake means prevents the skate board vehicle from unintentionally moving, without control, down a slope on which the skate board is being used.

As mentioned above, when the person using the skate board jumps or falls off the platform, the brake system is activated and the skate board vehicle is stopped; also, as mentioned above, the compressed spring the brake means can be effectively utilized with one or all of the wheels of the skate board vehicle, however, the desired effect, i.e., stopping the skate board from running away, can be accomplished by braking only a single wheel.

Various types of compression spring means may be utilized in the instant invention, however, the most convenient is such that the weight of the user on the platform will cause constant depression of the compression spring means and disengagement of the braking system, and in a preferred embodiment, the brake-effected wheel or wheels are disposed on a slide, and the position of the slide and the distance of the slide with respect to the plane of the platform is changed during the compressing movement of the user on the platform; this guaranteeing that during use the skate board will function correctly.

As will become apparent, the carrier plates which activate the braking system are preferably on a sliding carriage, while the spring means of the braking system are generally disposed between the slide and the skate board vehicle platform. Further, it is contemplated within the invention, that the spring means comprise a spring element which is inter-changeably arranged, i.e. accordingly, the spring can be changed or substituted, depending on the weight of the individual using the skate board. Further, the spring means or inter-changeable spring element, is not the only element which controls the braking system where the skate board vehicle is used under normal conditions. Correctly-dimensioned spring elements will provide improved control characteristics for the skate board vehicle, and thrusts and shocks can be absorbed, i.e., when the skate board vehicle moves over a relatively rough surface; accordingly, controlling and guiding the skate board vehicle is improved.

Another detail of the invention concerns a bearing block mounted on the underside of the platform of the skate board vehicle, the bearing block carrying the sliding carriage, and the carriage is tilted at about 40° to a horizontal plane; this direction, on one hand, has construction advantages; which will be explained in detail, and, on the other hand, the slide generally moves in a trajectory or plane that corresponds approximately with the direction of thrusts or shocks to the wheels of the wheel- and-axle assembly; it being noted that by disposing the slide in the trajectory of the thrust affecting the wheels, friction forces are generally reduced.

The braking system utilized in the instant invention, can take different forms, and, more particularly, in the exemplary embodiment, the braking system incorporates a pivotal sleeve, preferably positioned on the bearing block, the sleeve having a downwardly-directed end portion effecting braking of the wheel or wheels; the sleeve is subject to forces of the spring element which press the end of the sleeve onto the circumference of the wheels, and the end portion of the sleeve is preferably provided with a synthetic braking element or surface for reducing wear on the individual parts. In this construction, carrier plates are arranged between the pivot point of the sleeve and the end portion effecting braking of the sleeve, and during movement of the slide, the carrier plate pivots on a shorter pivot axis than the sleeve so that the sleeve is lifted off of the circumference of the brake wheel, even though the wheel is moved toward the braking sleeve during compression of the spring element, i.e., when the weight of a user is imposed on the platform of the skate board vehicle.

In the light of what has been mentioned above, in order to improve the controllability of the skate board vehicle, the invention further includes a pivotal axle arranged in the sliding carriage, substantially parallel to the slide trajectory about which the wheel- and-axle assembly is movable relative to the sliding carriage; the substantially 40° or 45° slide trajectory and commensurate movement of the pivot axle has the effect, during lateral tilting of the wheel-axle effecting a corresponding steering movement causing the platform of the skate board vehicle to move toward the side of the tilt; this effect being obtained so that the lengthened slide trajectory or tilt axles of both wheel- and-axle assemblies are disposed below the plane of travel to form a substantially wide angle which opens upwardly toward the platform.

Further, to obtained improved steerability, dampening elements are provided between axle supports and the slide member, which may consist, for example, of an elastic material and have a substantially drum-shape between which is clamped an axle-carrier. Precise fixation of the center position of the axle carrier, or the axle, is not required, since with a level platform, the axle will always assume the center position, although, resilient resetting elements may be utilized, they are not absolutely necessary.

Another simplification of the construction comprises lengthening, to some extent, a pin which forms the pivotal axle for the axle carrier, and which pin is directed parallel to the slide trajectory of the wheel- and axle-assembly, being such that this pin produces guidance for the spring element of the assembly, which slide is supported on the platform, or on a block, which is arranged on the platform.

In general, it will be sufficient if only the rear wheel axle- and-wheel assembly of the skate board vehicle is provided with a braking device, however, for purposes of simplification, it may be advantageous to provide braking systems for both the front and rear wheel- and-axle assemblies, as well as incorporating similar or identical wheel- and-axle assemblies in which both assemblies generally incorporate the same cooperating components heretofore referred to.

These, together with other objects and advantages, will become apparent from the consideration of an exemplary embodiment of the instant invention when taken in conjunction with the drawings, forming a part thereof, in which:

DESCRIPTION OF THE FIGURES OF THE DRAWINGS

FIG. 1 is a side-elevational view, essentially diagrammatic, of a skate board vehicle incorporating the invention;

FIG. 2 is an enlarged side-elevational view of the left-hand end of FIG. 1, showing in phantom lines altered positions of the cooperating components;

FIGS. 4 and 5 are respective side-elevation and bottom plane views of the bearing block component of the wheel- and-axle assembly of FIGS. 2 and 3;

FIGS. 6, 7 and 8 respectively show a side-elevational, transverse sectional and top plane view of the slide element of the invention; and FIGS. 9 and 10 are respective transverse cross-section and end elevational view of the axle carrier of the invention.

DESCRIPTION OF A PREFERRED EMBODIMENT

Figure 3:
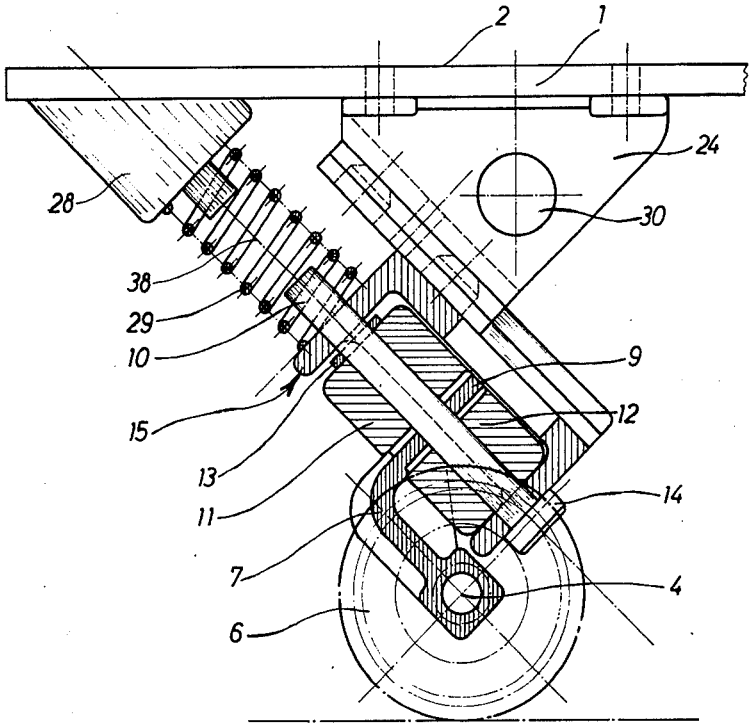
FIG. 3 is a cross-section generally on the longitudinal axis of FIG. 2 for the purpose of showing assembly details.

The skate board vehicle generally comprises a platform 1, the upper portion of which providing a support surface 2, and a two-part running means or chassis assembly mounted on the underside of the platfor 1 adjacent opposite ends thereof. The principle running direction of the skate board vehicle is shown by the arrow 3 and thus a rear axle is indicated by 4 while 5 indicates the front axle.

The skate board vehicle may have a length of about 65 cm, with a maximum width of 17 cm. The outer edges of the wheels of both wheel assemblies are spaced approximately 16 cm and the wheels, per se, will have a rolling surface of a width of about 5 cm. These dimensions are exemplary, and changes may be made therein.

Referring more particularly to FIGS. 2 and 3, the wheel- and-axle assemblies will be particularly described relative to the rear assembly identified by the axle 4. Suitably mounted on the axle 4 are wheels 6, which are generally cylindrical and amay be produced from a synthetic material, for example. Indicated generally at 7 is an axle support, this support is most clearly illustrated in FIG. 9 and 10. The axle supports, as seen in FIG. 9, is generally right-angular, in elevation, as seen in FIG. 9, including transverse bores 8 which receive the wheel axles for the individual wheels 6. Disposed above the bores 8, and generally reinforced by a gusset plate or webs, is a transversely apertured turning plate 9 which will be pivotally mounted on a pivot pin 10; see FIG. 3. The turning or pivot plate 9 is clamped between dampening cushions 11 and 12 and the cushions 11, 12 and the pivoting plate 9 are retained in assembled relation by a lock nut or washer accommodated on a suitable portion of the pin 10 and compressing elements 11, 9 and 12 together; it being noted that the pin 10 includes an enlarged head 14 for holding the parts in assembled relation.

Indicated at 15 is a slide or guide element, the details of which being particularly apparent in FIGS. 6–8. The slide 15 is generally U-shaped in elevation, including depending flanks or flanges 16 and 17 having extending transversely therethrough aligned bores 18 and 19, respectively; which receive therethrough the pin 10, and lateral reinforcing ribs or webs 20 are integrally connected to the flanges 16 and 17. The guide member 15 includes a transverse plate portion 21 having formed in the upper surface thereof opposed, open-ended tracks or grooves 22; see particularly FIG. 7, which receive therein track—guides 23 of a bearing block 24; the latter being most particularly illustrated in FIGS. 4 and 5. The transverse portion 21 has extending longitudinally therethrough an elongated slot 25 which receives therethrough the cooperating portion of the bearing block 24 accommodating therethrough grooves or the like in boreholes 26 of the bearing block 24.

The bearing block 24 is secured to the under-surface of the platform 1 by means of transversely apertured, laterally-extending ear elements 27; see FIGS. 4 and 5. Considering FIGS. 3–8, it will be observed that the grooves 22 will receive the left-hand portion of the bearing block 24; see FIG. 5, and this bearing block will permit reciprocating movements of the slide member of FIGS. 6–8, such slide members supporting the elements 7 carrying the axle or pivot pin 10.

Depending beneath the platform 1, as most clearly seen in FIGS. 2 and 3, is an abutment or support element 28 having an axially-extending pin, disposed at approximately 45° with respect to the plane of the platform 1, and having circumposed thereabout one end of a coil spring 29, the other end of which engaging about the pin 10 and abuttingly engaging the slide 15. The compression spring 29 normally urges the slide element 15 into the position shown in FIG. 3, i.e., opposite the position which the slide element assumes when a user's weight is placed on the upper surface 2 of the platform 1.

The front wheel axle 5 will incorporate parts corresponding to those previously mentioned with respect to axle 4, i.e., incorporating a slide 15 and bearing block 24, similar to those previously described, however, slide and bearing block at the front end can be rigidly connected to each other and accordingly, the spring such as that illustrated at 29 can be eliminated. As seen in FIG. 1, the wheel-and-axle assemblies at the front and rear ends of the skate board vehicle platform 1 are essentially disposed in a mirror-image relationship and are essentially the same, but in reversed relationship, as compared with the wheel-and-axle assemblies incorporating the axle.

When the platform 1 is tilted essentially parallel to its direction of movement, i.e., by applying or shifting the user's weight to one side-edge or the other of the platform, and this side-edge of the platform is lowered, tilting of the axle 4 of the pivot pin 10 at the rear of the skate board vehicle will result, and accordingly, depending upon which side the weight is shifted to, there results a turning or curving of the skate board vehicle essentially similar to slalom-type water-skiing where only a single ski is used.

The bearing block 24, as seen in FIG. 5, incorporates transverse apertures 30 in which is disposed an axial element 32 of a braking assembly 31. The braking assembly 31 essentially comprises the axial element 32 comprising a depending arm 33 having at its lower terminal end a synthetic coating 34 which will engage the outer circumference of a respective wheel, i.e., wheel 6, as illustrated in FIG. 2. The braking assembly 31 includes a pair of the arms 33, comprising one arm of a hairpin spring, the intermediate coil spring thereof being circumposed about opposite terminal ends of the pin or axle 32 and continuing at a bight portion 35 which extends about the rear end of the bearing 24. The hairpin spring normally urges the synthetic coating 34 into braking engagement with the outer circumference of the pair of wheels supported on the axle 4. This braking effected by the hairpin spring functions to engage and brake the wheels 6 in the event the user of the device no longer rests his weight on the upper surface 2 of the platform 1.

The slide 15 which moves generally upwardly or toward the left; see FIG. 2, when a user applies his weight to the platform 1, incorporates thereon a carrier plate 36 at the outer surface of the slide 15, and the carrier plate engages the arms 33 (only one shown) so when the slide 15 moves upwardly or on the 45° plane illustrated, the braking element 34 will disengage the outer circumference of the wheel 6, and the spring 29 will be compressed. In this attitude, the wheel 6 will not be braked, and the skate board vehicle is used in a conventional manner.

Lifting of the arm 33 off the wheel 6 occurs when the arm 33 extends at essentially a right angle with respect to the direction of movement; see direction arrow 37 illustrating this direction of movement; thus, the release of the braking system will not interfere with the steering of the wheels, in a manner previously described.

As mentioned earlier, the compression spring element 29 can be of various strengths, depending upon the weight of the user, i.e., being a relatively young child, for example, as compared with a teenager or adult. The replacement or interchanging of compression spring 29 can be accomplished by thremoving the srew or screws from the bore holes 26 or by releasing the abutment block 28 from the platform 1.

It is contemplated within the scope of the invention, that if the compression spring 29 and abutment 28 are eliminated, and the spring of the braking assembly 31 is of sufficient strength, as it is disengaged from the wheels 6, through upward movement of the slide 15, it still will provide a resilient shock-absorbing support between the wheels on the axle 4 and the rear of the platform 1. In all other regards, turning, i.e., pivoting of the wheels about the pin 10, for example, is accomplished in the same manner as is the automatic braking of the rear wheels 6, when the slide 15 moves back to the position illustrated in FIG. 2.

What is claimed is:

1. In a skate board vehicle including a platform having front and rear wheel- and-axle assemblies, the improvement comprising a load-responsive braking assembly on said platform and including a braking portion releasably-displaceable in relation to a user's weight imposed on the platform during use of the skate board vehicle in a free-running attitude, at least one of said wheel- and-axle assemblies including at least one wheel normally, brakingly engaged by said braking portion when no user-load is imposed on said platform, so that a user's weight on the skate board vehicle releases the braking portion from braking engagement with said one wheel, said one wheel-and-axle assembly comprising bearing block means, said bearing block means slidably-supporting a slide element for movement toward-and-away from the platform, and an axle support depending from said slide element and supporting said at least one wheel upon which said skate board vehicle rides, said slide element including a portion engageable with said braking portion away from said one wheel as the slide element moves toward said platform.

2. The structure as claimed in claim 1 in which said load-responsive braking assembly includes a resilient element interposed between said platform and said one wheel, said resilient element comprising a spring normally urging said braking portion into engagement with said one wheel and normally urging said slide element away from said platform whereby the weight of the user, when imposed on the platform, causes the platform to move relative to said slide element and one wheel causing the braking portion to disengage said one wheel.

3. The structure as claimed is claim 2 in which said spring is removably-replaceably supported whereby springs of different strengths can be substituted one-for-the-other to accommodate for different user's of the skate board vehicle.

4. The structure as claimed in claim 1 in which said axle support includes a pair of wheels transversely spaced beneath the platform, said bearing block including means supporting said spring, said spring including a bight portion extending transversely at one end of said block, said bight portion being connected to a coil spring portion at said means supporting said spring on said block, said coil spring portion continuing as a pair of arms respectively depending adjacent a respective wheel of said one wheel-and-axle assembly, each of said arms including a braking surface.normally urged onto the circumference in braking relation to a respective wheel.

5. The structure as claimed in claim 8 in which said braking surface comprises a synthetic material.

6. The structure as claimed in claim 1 including a compression spring extending axially from beneath said platform toward and engaging said slide element and normally urging said slide element away from said platform so that said one wheel is to be braked.

7. The structure as claimed in claim 5 in which said compression spring is removably mounted and interchangeable with spring of other strength for accommodating the the skate board vehicle for use by different weighted users.

8. The structure as claimed in claim 1 in which said axle support comprises a pivot pin extending angularly toward the undersurface of said platform, resilient means on said pivot pin, a pivot element on said pivot pin in engagement with said resilient means whereby shifting of the user's weight toward one side edge or the other of the platform causes turning of the platform on the wheel-and-axle assemblies.

9. The structure as claimed in claim 8 in which said spring comprises a compression spring extending axially from and supported on an upper end of said pivot pin.

10. The structure as claimed in claim 8 in which said resilient means comprises a pair of resilient block elements, said axle support comprising a generally right-angled plate, in elevation, with one leg of the plate interposed between said pair of resilient block elements, another leg of said right-angled plate including lateral, axle-receiving portions.

* * * * *